United States Patent [19]

Barba et al.

[11] 4,415,289

[45] Nov. 15, 1983

[54] SELF-LOCKING NYLON POST

[75] Inventors: Joseph Barba, Jackson Heights; Gerd L. Hochrain, Seaford, both of N.Y.

[73] Assignee: Boorum & Pease Company, Brooklyn, N.Y.

[21] Appl. No.: 308,671

[22] Filed: Oct. 5, 1981

[51] Int. Cl.[3] ..... B42F 13/02

[52] U.S. Cl. ..... 402/17; 402/64; 402/80 P

[58] Field of Search ..... 402/17, 64, 65, 66, 402/61, 68, 80 P

[56] References Cited

U.S. PATENT DOCUMENTS 3,285,251 11/1966 Ivory et al. ..... 402/17

*Primary Examiner*—Mark Rosenbaum

*Attorney, Agent, or Firm*—Davis, Hoxie, Faithfull & Hapgood

[57] ABSTRACT

An improved loose leaf binder more particularly a binding post having a head of novel design. The novel head design facilitates the locking of binding post securely in the binder and the unlocking for removal from the binder.

6 Claims, 7 Drawing Figures

SELF-LOCKING NYLON POST

The present invention relates to improvements in loose leaf binders, particularly binders suitable for holding electronic data processing sheets. It is also suitable for holding loose sheets of all kinds.

Loose leaf binders typically include separable front and rear covers and some mechanism for fastening sheets of paper therebetween. One common variety of binder, illustrated for example in U.S. Pat. No. 3,285,251, utilizes removable flexible plastic posts as the fastening mechanism. One end of each post is removably secured in one of two binding elements attached to the covers, and the other end of the post passes through perforations in the sheets and then into the other binding element where it is bent over and held in place by a sliding latch. The utility of such binders is improved if the flexible post can be at once firmly yet rapidly installed in the first binding element so that its free end stands straight upright to facilitate loading of the sheets. The post should also be replaceable in case of damage without requiring replacement of the entire binder.

U.S. Pat. No. 3,285,251 discloses one means for quickly and removably locking a post into the binding element to form a strong yet inexpensive binder. Briefly, the device there disclosed involves a binding element formed as an elongated channel having a floor and a pair of side walls each having a U-shaped flange extending inwardly over the floor. The head of the post is designed with dimensions to cooperate with the channel so that in particular the height of a portion of the head fits snugly between the free edges of the U-shaped flanges and the floor of the channel. While this device when made according to the patent possesses all of the desirable features mentioned above, in fact in high production situations it has proven difficult to maintain the precise tolerances associated with the elongated channel. Further, the elongated channel is subject to distortion through hard customer use. As a result, the head of the post has not always been reliably held against accidental displacement.

The present invention is an improvement upon the invention disclosed in U.S. Pat. No. 3,285,251 which accomplishes the same objects but in a more reliable manner, utilizing a post having a head of novel design to cooperate in a novel manner with the elongated channel.

Figure 1:
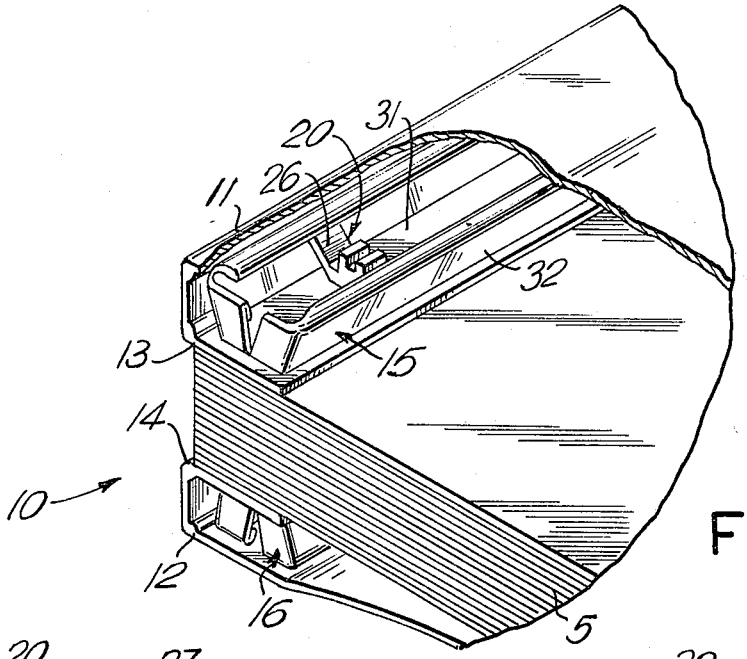
FIG. 1 is a partial perspective view, partly cut-away, of a loose leaf binder incorporating the self-locking post of the present invention.

Referring to the drawings, FIG. 1 shows a binder 10 including the elements of the present invention. The binder comprises front and back covers 11 and 12, each having an inwardly folded binding flap 13 and 14 connected thereto along one edge. Binding elements, shown as elements 15 and 16, are connected to each binding flap by rivets or other connectors. The binding elements may be made of metal, plastic or other known material and will be described more fully hereafter. The loose leaves 5 are held between binder flaps 13 and 14 by means including post 20, also described more fully hereafter.

Figure 2:
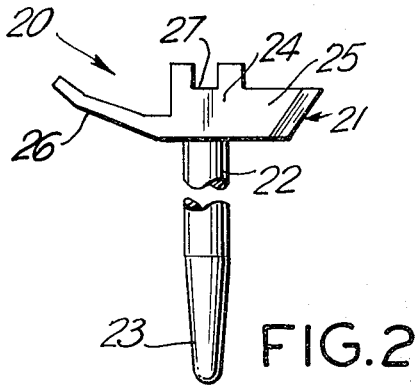
FIG. 2 is an elevation view of the post of the present invention.
Figure 3:
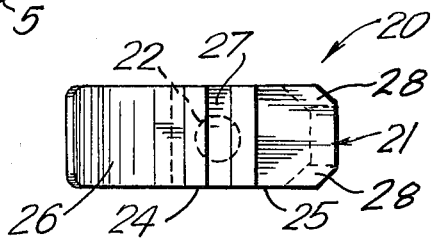
FIG. 3 is a top view of the post shown in FIG. 2.

Post 20, shown in detail in FIGS. 2 and 3, includes a head 21 of particular and novel design, an intermediate portion 22 and a free end 23. It is preferably made of a water conditioned stiff but resilient plastic material such as nylon.

The two binding elements 15 and 16 are preferably identical. Each is dimensioned to cooperate with the head of the post or with a retaining latch of the type known to the art for releasably holding in place the free end of a post. For convenience, this application will describe the invention with respect to binding element 15, but it should be clear that the head of the post could cooperate in identical fashion with binding element 16. Depending on the particular use made of the binder, either arrangement may be preferred.

Figure 4:
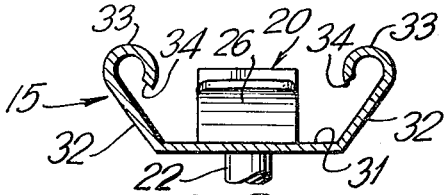
FIG. 4 is a cross-section of the binding element showing the post in its open or unlocked position.
Figure 6:
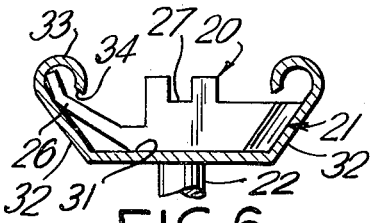
FIG. 6 is a cross-section similar to FIG. 4 but showing the post in its closed or locked position.

The binding element 15 is an elongated channel substantially the length of the binding edge of the binder. See FIG. 1. As shown in FIGS. 4 and 6, it comprises a floor 31 and a pair of side walls 32 each having a U-shaped flange 33. The internal angle between the floor 31 and the walls 32 is an obtuse angle equal to about 125°, as shown for example in FIGS. 4 and 6. Free edge 34 of the flange 33 is spaced both vertically and horizontally from the wall 32.

The floor of binding elements 15 and 16 contain at least two pairs of aligned openings for passage of the free end 23 of the post. These openings should also align with openings in the sheets to be bound in the binder.

Referring again to post 20, its head 21 is designed to cooperate with the walls of the binding element 15. As seen in elevation, head 21 includes thicker central and rear portions 24 and 25 and a relatively thin tongue 26 which extends outward from the central portion preferably at an angle of about 20° from the horizontal. Central portion 24 preferably includes an upstanding slot 27 designed to receive a screwdriver, coin or other device for rotating the head. In the preferred form shown in the drawings the corners of the rear portion 25 of the head are cut away, as illustrated by the beveled edges 28 of FIG. 3. The greatest width of the head 21 is less than the distance between the U-shaped flanges 33 of the channel. See FIGS. 4 and 5 which show the post 20 inserted in binding element 15 in its open position.

Figure 5:
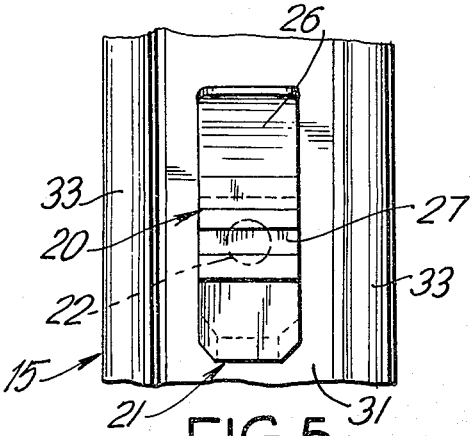
FIG. 5 is a plan view of the binding element showing the post in its open position.
Figure 7:
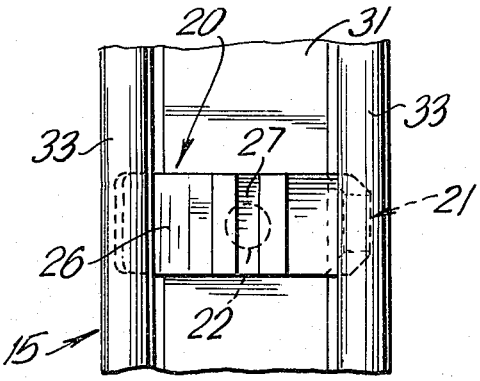
FIG. 7 is a plan view of the binding element showing the post in its closed position.

When the post is inserted in the binding element as shown in FIG. 4 and 5, tongue 26 does not engage any part of the binding element 15. However, when post 20 is rotated, as by the twisting of a coin in slot 27, tongue 26 will swing beneath the free edge 34 of flange 33 into the position shown in FIGS. 6 and 7. In this position, the free end of tongue 26 presses against side wall 32 of the binding element 15, and that force holds the head 21 firmly in place. In the preferred embodiment, the tongue 26 is of sufficient length that it will be forced to flex upward as it moves into the position shown in FIGS. 6 and 7. Of course, rotation of head 21 in a clockwise direction as viewed in FIG. 6, as would be necessary to relieve the force on tongue 26, is prevented by the abutment of the lower face of rear head portion 25 on floor 31 of the binding element. The flexing of tongue 26 insures a reliable force between head 21 and binding element 15 even if, as is sometimes the case, the angle between floor 31 and side walls 32 of the binding element is not as intended or uniform.

In using the binder, the free end 23 of the post 20 is inserted through a passage in the floor 31 of binding element 15 until the underside of the head 21 contacts floor 31 of the binding element. During this process the head of the post is held in, or is turned to, the position shown in FIGS. 4 and 5, that is to say, with the longer dimension of the head lying lengthwise of the binding element. When the head is in this position the post can be inserted in or withdrawn from the binder at will. To lock the post in the binder the operator gives the post a quarter turn, either clockwise or counterclockwise, to the position shown in FIG. 7. In this locked position the tongue 26 of the head bears against one of the side walls 32 of binding element 15 and holds the post locked in the binding element. To unlock and remove the post, the operator must again turn the head substantially a quarter of a turn in either a clockwise or a counterclockwise direction.

After the free end of the post has gone through the passage in one of the binding elements, it passes through an aligned passage in binding flap 13, through a passage in sheets 5, then through a passage of the second binding flap 14 and a passage in the second binding element 16. If the head of the post was not previously turned to locking position in the binding element, it should be so turned and locked at this point in the operation. The second binding element is then pushed down firmly upon the sheets and the free end of the post is bent over to lie on the floor of its channel. A sliding latch as known in the art is slid over the free end of each post and toward the end of the binder at which is located the head of that post. The post will be held in the desired bent over position by friction between the intermediate portion 22 of the post and the sliding latch and friction between the latch and the side walls and flange of the channel.

We claim:

1. Fastening means for a loose leaf binder comprising:

(a) a binding element comprising a channel with a longitudinal axis having a floor with an opening therethrough, and side walls, the internal angle between the floor and the side walls being obtuse, each side wall having an inwardly extending flange;

(b) a post having a head portion, an intermediate portion and an end portion, the head portion being larger than the opening in the floor of the binding element, the intermediate and end portions being able to pass through said opening; the head portion of the post having a relatively thin flexible tongue that extends outwardly a distance such that, when the post is mounted in the binding element by inserting the intermediate and end portions through the opening and turned so that the tongue is oriented substantially perpendicular to the longitudinal axis of the channel, the tongue engages one of the side walls and flexes upwardly, the tongue having a width such that, when the post is mounted in the binding element and turned so that the tongue is oriented parallel the longitudinal axis of the channel, the tongue does not engage either of the side walls.

2. The fastening means of claim 1, wherein the tongue and the channel floor form an angle of approximately 20° when the tongue is not flexed by engagement with either of the side walls.

3. The fastening means of claim 2, wherein the head portion of the post further comprises a rear portion which extends outwardly in a direction opposite the direction in which the tongue extends outwardly from the post.

4. The fastening means of claim 3, wherein the obtuse angles between the side walls and the floor are substantially equal and the rear portion has a surface which is beveled to fit said angles.

5. The fastening means of claim 4, wherein the obtuse angles between the side walls and the floor are approximately 125°.

6. The fastening means of claim 5, wherein the post further comprises a slot for turning the head portion of the post so that it is engaged with or disengaged from a side wall of the binding element.

* * * * *